United States Patent [19]

Fromont et al.

[11] 4,261,156

[45] Apr. 14, 1981

[54] CONSTRUCTION UNITS AND STRUCTURES THEREFROM

[76] Inventors: Michel M. V. C. Fromont; Marguerite S. Fromont, both of 2, rue Saint-Leger, 78100 Saint-Germain-en-Laye, France

[21] Appl. No.: 815,672

[22] Filed: Jul. 14, 1977

[30] Foreign Application Priority Data

Jul. 21, 1976 [LU] Luxembourg ..... 75429
Apr. 13, 1977 [FR] France ..... 77 11014

[51] Int. Cl.[3] ..... E04C 3/34; E04C 5/16; E04C 3/30

[52] U.S. Cl. ..... 52/724; 52/684; 52/722; 52/723; 52/732

[58] Field of Search ..... 52/252, 486, 684, 685, 52/580, 583, 309.13, 309.14, 309.15, 309.16, 309.17, 722, 723, 724, 732, 729, 730

[56] References Cited

U.S. PATENT DOCUMENTS

| | | | |
|---|---|---|---|
| 866,940 | 9/1907 | Lipman | 52/723 |
| 947,514 | 1/1910 | Stevens | 52/724 |
| 991,603 | 5/1911 | Brooks | 52/729 X |
| 1,151,378 | 8/1915 | Neevel | 52/685 |
| 1,285,051 | 11/1918 | Cramer | 52/724 |
| 1,842,144 | 1/1932 | Bohnsack | 52/732 |
| 1,852,833 | 4/1932 | Borsky et al. | 52/732 X |
| 2,104,506 | 1/1938 | Coddington | 52/724 X |
| 2,190,004 | 2/1940 | Baker | 52/730 X |
| 3,332,197 | 7/1967 | Hinkle | 52/732 X |
| 3,495,371 | 2/1970 | Mitchell, Jr. | 52/252 X |
| 3,562,970 | 2/1971 | Schwartz | 52/729 X |
| 3,565,264 | 2/1971 | Guiher | 52/729 X |
| 3,673,753 | 7/1972 | Anderson | 52/685 |
| 3,722,157 | 3/1973 | Prokop | 52/580 X |
| 3,890,759 | 6/1975 | Selden et al. | 52/730 X |

FOREIGN PATENT DOCUMENTS

| | | | |
|---|---|---|---|
| 583107 | 9/1959 | Canada | 52/730 |
| 2451341 | 4/1975 | Fed. Rep. of Germany | 52/725 |
| 1205184 | 2/1960 | France | 52/684 |
| 537658 | 1/1956 | Italy | 52/725 |
| 414277 | 8/1934 | United Kingdom | 52/729 |
| 670026 | 4/1952 | United Kingdom | 52/724 |

*Primary Examiner*—Leslie Braun
*Attorney, Agent, or Firm*—Webb, Burden, Robinson & Webb

[57] ABSTRACT

Construction units for permanent structures. Said construction units comprise cold-stamped sheet metal jackets filled with a setable filler which may or may not be reinforced with rods.

9 Claims, 10 Drawing Figures

CONSTRUCTION UNITS AND STRUCTURES THEREFROM

The present invention relates to new construction units for assembling composite structures. Said construction units are composed of jackets of cold-stamped steel and, for example, concrete filler optionally reinforced with steel rods. The structures may be used for building houses, hangars, sheds and permanent structures of all kinds.

It is known to make economical structures with contoured metal sheets. The use of the contoured metal sheets requires precautions to avoid warping of the body of the sheet sections, twisting of flanges, and tearing of the sheets at points where engaged by fasteners. These disadvantages may, to some degree, be overcome by partially or completely enveloping the contoured sheets with concrete or other suitable setable filler.

The composite structures of the prior art are often composed of cold-stamped sheet metal sections and of concrete that is or is not reinforced with steel rods. After setting of the concrete the structural elements are difficult to join one to another or to other traditional structural elements.

It is an advantage according to the present invention to remedy these drawbacks by providing a construction unit which is, at least in part, based upon the unique shape of the sheet metal jackets and by optionally using tabs stamped from the sheet metal jackets to secure reinforcing rods thereto.

Briefly according to this invention, construction units comprise sheet metal jackets designed to be reinforced by a setable filler material, such as concrete, which is poured within the jacket. The sheet metal jackets comprise a generally flat face and two opposed relatively smaller edge faces. The construction units have at least one hollow flange along an edge face. The flange comprises a portion of the sheet metal jacket, the generatrices of which are parallel to the generatrices of the flat face. The flanges enclose an elongate hollow cavity along the length of the edge face because the jacket has been crimped to touch near the edge faces sufficiently to keep out setable filler when it is poured into the jacket. The hollow flange may be deformed by collapsing into the hollow cavity thereof at any location along the edge face where a fastener or like device is drawn up against it. It is preferable, according to this invention, that the jackets have tabs stamped therein which tabs are bent into the interior of the jacket. The tabs have tongues that can be pressed around reinforcing rods whereby the construction units after being filled with setable filler have the traditional reinforced concrete structure.

Further features and other objects and advantages of this invention will become clear from the following detailed description made with reference to the figures, in which FIG. 1 shows a portion, partially in section, of a sheet metal jacket with a hollow flange secured to a structural element;

Figure 1:
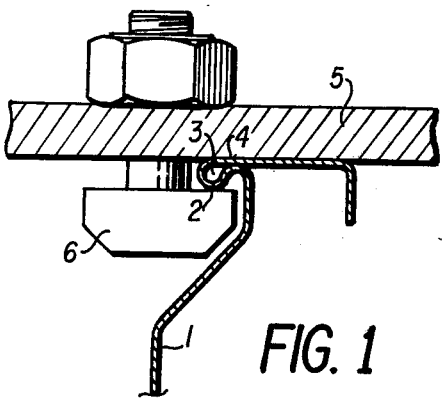

Referring now to FIG. 1, in accordance with this invention, jackets of contoured sheet metal define, at least partially, a flange 2 which is parallel to the generatrices of the sections and further define an internal cavity 3 which remains relatively empty when concrete that constitutes the remaining part of the composite structure is poured therein because of the junction of the neck 4.

This arrangement makes it possible, after the concrete has been poured, to secure the composite structures to a structural element 5 for example by means of a fastening member 6, such as a headed bolt which rests against the flange 2. After local collapse of the flange into the cavity 3, any sliding of the assembly is avoided due to the tightening achieved by member 6. The dimensional characteristics of the flange 2 and the cavity 3 depend upon the type of assembly made and may be as large or as small as necessary.

Figure 2:
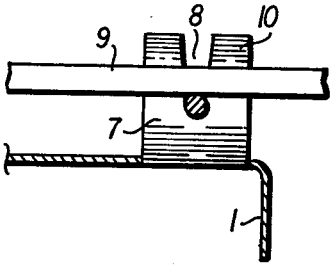
FIG. 2 shows a section of a contoured sheet metal jacket having stamped out tabs to enable the connection between the sheet metal jacket and the steel reinforcing members of a traditional composite structure of reinforced concrete.
Figure 3:
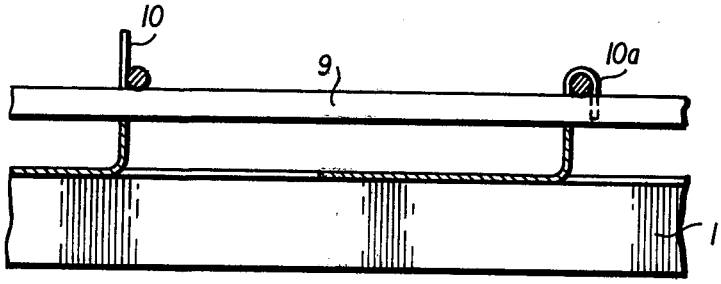
FIG. 3 is a longitudinal section of the jacket shown in FIG. 2.
Figure 4:
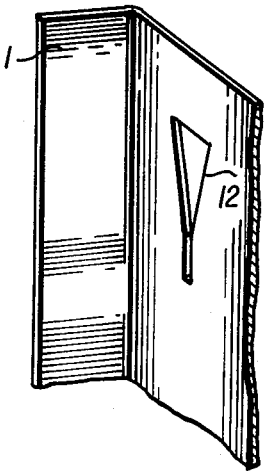
FIGS. 4 and 5 are perspective views of the stamped tabs and slots made in the jackets.
Figure 5:
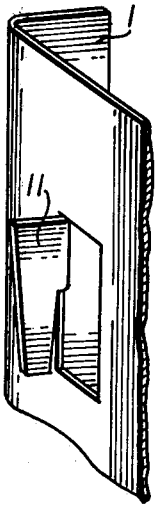
Figure 6:
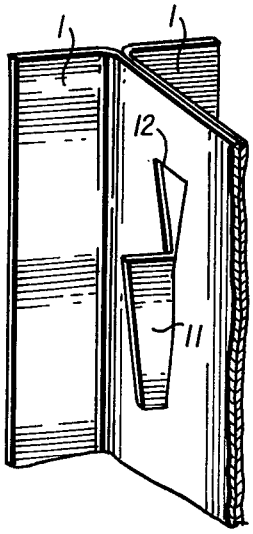
FIG. 6 is a perspective view showing jackets of FIGS. 4 and 5 in the assembled position.
Figure 7:
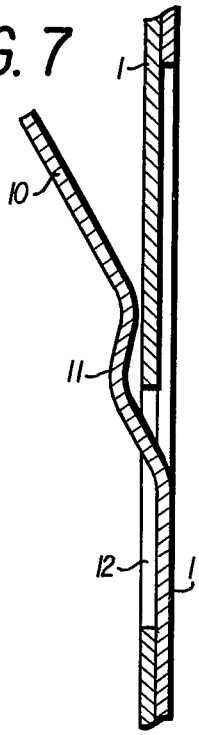
FIG. 7 represents a longitudinal section of another type of stamped tab and slot that allows the jackets to be assembled one to another.

Referring now to FIGS. 2 and 3, tabs 7 are provided in the contoured sheets 1 by stamping the said sheets 1. At the free ends, the tabs include slots 8 for engaging reinforcing member 9 belonging to a traditional reinforced concrete structure. In order to enhance the connection with reinforcing members 9, the free ends of the tabs 7 may be in the form of small tongues for pressing down at 10*a* on reinforcing members or rods 9.

Referring now to FIGS. 4, 5, 6 and 7, the assembling of two composite structures may be effected, for example, by the engaging of tabs 11 and slots 12. Prior to the pouring of the concrete, the tabs 11 and slots 12 are engaged thereby joining together the sheet metal jackets that constitute individual construction units.

Figure 8:
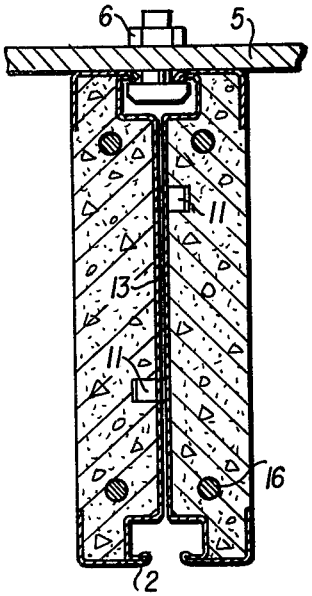
FIG. 8 shows two composite construction units according to this invention, in section, which units are filled with concrete and reinforced with steel rods. The units are provided with the features illustrated in FIGS. 1 to 7.

Referring to FIG. 8, applying the means described in FIGS. 1 to 7, two composite structures composed of sheet metal jackets 13 that were cold-stamped are assembled back-to-back by connecting tabs 11 which penetrate into the associated slots. The flanges of the said envelopes include flanges 2 which take part in securing elements 5 by means of bolts 6.

Figure 9:
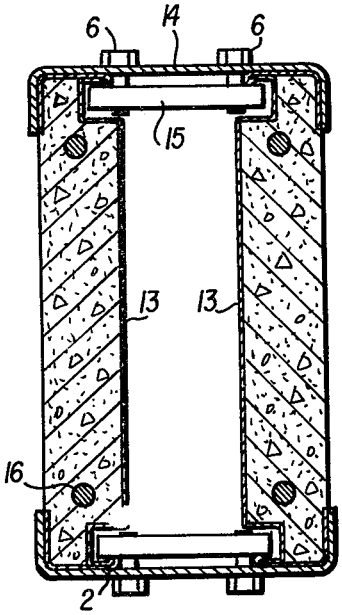
FIG. 9 is a section of two composite structural units according to this invention filled with concrete and reinforced with steel rods. These two units are joined one to another by small strips and fasteners and the flange illustrated in FIG. 1.

Referring now to FIG. 9, applying the means that form the subject matter of FIGS. 1 to 7, two construction units composed of cold-stamped sheet metal jackets 13 are assembled by means of small channels 14 associated with fastening elements 6, such as, for instance, bolts with nuts or threaded reinforcing plates 15. The spacing between the said jackets may be zero or as large as necessary. Generally, steel bars 16 may be integrated with the composite structures by way of reinforcement either locally or along their entire length (FIGS. 8 and 9).

Figure 10:
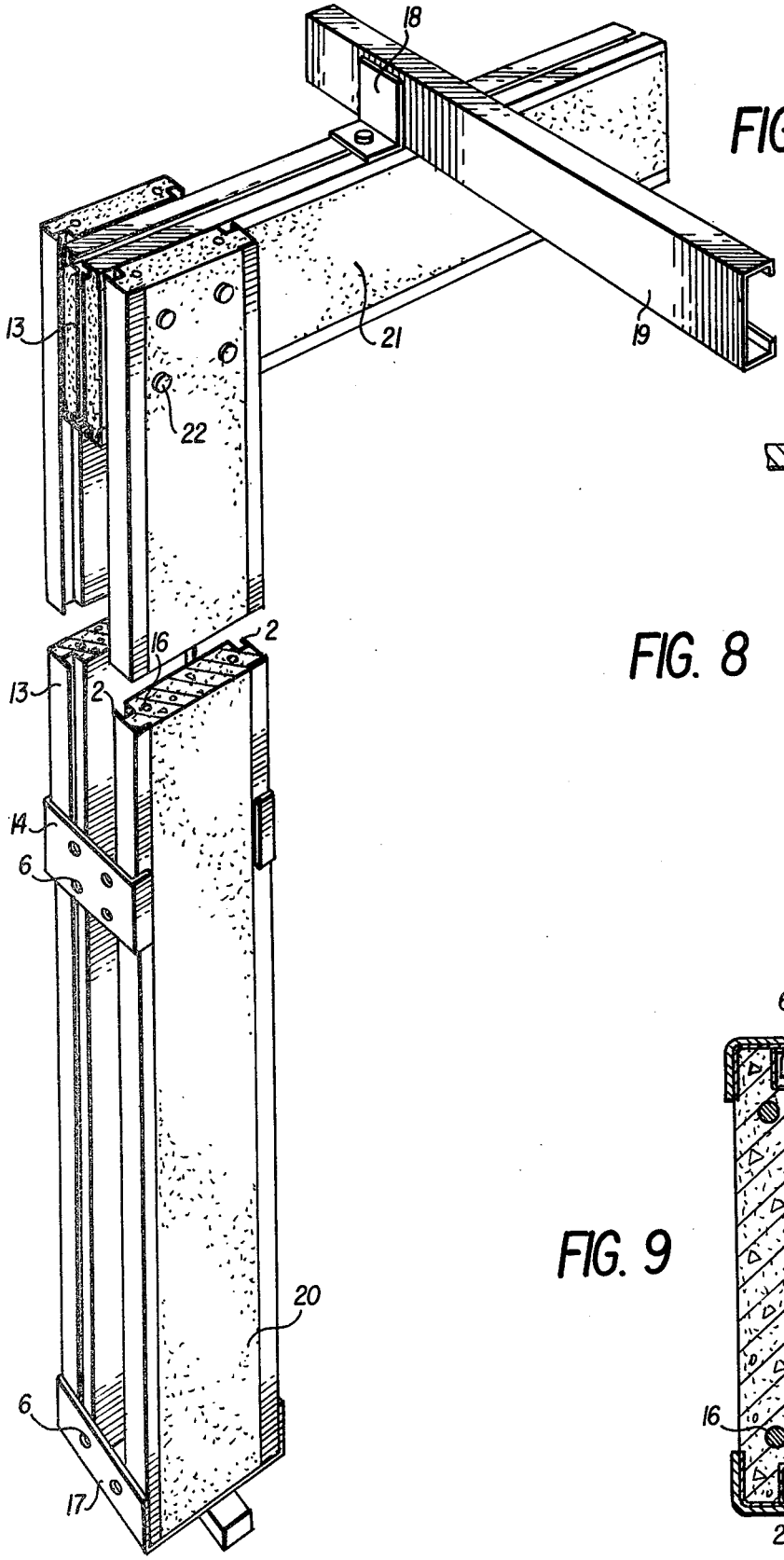
FIG. 10 is a perspective view of construction units according to this invention assembled together as a composite structure such as a shed or hangar.

Referring now to FIG. 10, by way of an example of the application of construction units according to this invention and forming composite structures therefrom, posts 20 and traverses 21 partially constituting a composite structure such as a shed or hangar are assembled of construction units 13. The units are secured together by the flanges and fastening plate 17, channels 14 and the fastening plates 17 at the base of the post 20. Brackets 18 maintain the purlins 19 which support the roof. Posts 20 and traverses 21 are assembled by spikes or bolts 22.

The composite construction units comprising jackets such as 13 in FIG. 9 may be used when laid flat, as flat slabs, and when disposed vertically, they may be used as wall elements. Alternatively, flanges 2 insure their connection with one another and with the main structure of the building and also make it possible to secure secondary elements, such as, for example, pipelines, false ceilings, partitions, doors or window jambs thereto.

The sheet metal jackets of the construction units may be cold-stamped of different shapes with tabs, whose purpose is to improve the union between the sheets and the concrete filler.

Having thus defined our invention in the detail and particularity required by the Patent Law, what is desired covered by Letters Patent is set forth in the following claims.

We claim:

1. Construction units comprising sheet metal jackets designed to be reinforced by a setable filler material poured within the jacket, said construction units having a generally flat face (1) and two opposed relatively smaller edge faces, said construction units having at least one hollow flange (2) along an edge face, said flange comprising a portion of the sheet metal jacket the generatrices of which are parallel to the generatrices of the flat face, said flange enclosing an elongate hollow cavity along the length of the edge face because said jacket has been crimped to touch near the edge faces sufficiently to keep out setable filler when it is poured into the jackets, and such that said flange may be deformed by collapsing into the hollow cavity thereof at any location along the edge face where a fastener or the like is drawn up against it.

2. Construction units according to claim 1 further comprising a concrete filler.

3. Construction units according to claim 1 in which the jackets have tabs and slots stamped therein, which tabs may engage slots on adjacent construction units insuring a union.

4. Construction units according to claim 1 in which the jackets have tabs stamped therein bent into the interior of said jacket, said tabs having tongues that can be pressed around reinforcing rods whereby said construction units after being filled with setable filler have the traditional reinforced concrete structure.

5. Construction units according to claim 4 further comprising concrete filler.

6. Construction units according to claim 4 wherein said tabs have adjacent tongues, reinforcing rods placed between said tongues aligned in one direction, reinforcing rods placed along side said tongues aligned in the perpendicular direction and bent over said latter rods, such that a reinforcing rod grid is supported by said jacket.

7. Construction units according to claim 6 further comprising concrete filler.

8. Composite structures made from a plurality of construction units as defined in claim 1 in which said units are connected one to another by assembly elements (14) which abut against at least a portion of said hollow flanges and are secured thereto by fasteners.

9. Composite structures according to claim 8 further comprising concrete filler.

* * * * *